United States Patent [19]

Popitz

[11] Patent Number: 5,048,136

[45] Date of Patent: Sep. 17, 1991

[54] INFANT SUPPORT

[75] Inventor: Michael D. Popitz, Newton, Mass.

[73] Assignee: Brigham & Women's Hospital, Boston, Mass.

[21] Appl. No.: 593,651

[22] Filed: Oct. 3, 1990

[51] Int. Cl.[5] ..... A47C 16/00

[52] U.S. Cl. ..... 5/431; 5/436; 5/481; 128/870

[58] Field of Search ..... 5/424, 431, 434, 436, 5/446, 464, 481; 128/846, 869, 870; 269/328

[56] References Cited

U.S. PATENT DOCUMENTS

| | | | |
|---|---|---|---|
| 2,281,629 | 5/1942 | Snow . | |
| 2,389,269 | 11/1945 | Mermis . | |
| 3,521,310 | 7/1970 | Greenawalt | 5/436 |
| 4,030,719 | 6/1977 | Gabriele et al. | 269/328 |
| 4,259,757 | 4/1981 | Watson . | |
| 4,320,543 | 3/1982 | Dixon | 5/436 X |
| 4,383,713 | 5/1983 | Roston | 5/431 X |
| 4,494,261 | 1/1985 | Morrow | 5/436 |
| 4,501,034 | 2/1985 | Greenawalt . | |
| 4,631,766 | 12/1986 | Semmler et al. | 5/436 X |
| 4,757,811 | 7/1988 | Clark . | |
| 4,768,246 | 9/1988 | Summer . | |
| 4,825,487 | 5/1989 | Eberl | 5/436 X |
| 4,899,405 | 2/1990 | Rothbard . | |
| 4,907,306 | 3/1990 | Nakaji | 5/436 |

FOREIGN PATENT DOCUMENTS

| | | | |
|---|---|---|---|
| 0037390 | 3/1981 | European Pat. Off. . | |
| 1031814 | 6/1966 | United Kingdom | 5/481 |

OTHER PUBLICATIONS

Barash et al.; *Clinical Anesthesia;* pp. 1258–1266.

*General Approach to Pediatric Anesthesia* (author and date unknown).

*Smiths Anesthesia for Infants & Children,* 5th ed., pp. 74–76, 1990.

*Primary Examiner*—Michael F. Trettel

*Attorney, Agent, or Firm*—Sterne, Kessler, Goldstein & Fox

[57] ABSTRACT

The present invention provides a full body support for an infant which automatically aligns the oropharyngeal, laryngeal and tracheal axes of the infant head and neck for airway management. The support includes a first cushion and a second cushion, the first cushion having a head-receiving opening, a body-receiving opening and a neck-supporting surface to extend the neck of the infant. The second cushion is disposed beneath the first cushion and provides a head-supporting surface and a body-supporting surface within the head-receiving opening and body-receiving opening, respectively. When an infant is properly positioned on the support, the airway axes of the infant head and neck are automatically opened and aligned for airway management. The support may also be used to provide general comfort to an infant resting thereon during any type of pre- or post-operative care.

31 Claims, 2 Drawing Sheets

INFANT SUPPORT

FIELD OF THE INVENTION

The present invention relates to an infant support, and more particularly to an infant support for restraining the infant's head and body during medical procedures and for aligning the oropharyngeal, laryngeal and tracheal axes of the head of an infant for airway management.

BACKGROUND OF THE INVENTION

Many medical procedures used today require some method of airway management. Examples of such procedures include general anesthesia/intubation, mask anesthesia, regional anesthesia/sedation with $O_2$ supplementation, and semi-surgical and radiologic procedures. Many patients die unnecessarily due to an inability to ventilate or the difficulty encountered during endotracheal intubation. Endotracheal intubation and other methods of airway management are especially difficult to perform on a premature or full-term infant.

Successful airway management requires aligning the oropharyngeal, laryngeal and tracheal axes of the head and neck such that a straight, unobstructed airway passage is formed between the mouth and the larynx. The positioning of the oropharyngeal, laryngeal and tracheal axes is commonly known as the "sniffing position" and has been determined to be the most effective position for improved airway patency and endotracheal intubation.

While achievement of the sniffing position for an adult is difficult for even a skilled anesthetist, achievement for an infant is even more difficult given several anatomic differences relative to an adult. Some of these differences include a large tongue, a high glottis, a narrow cricoid ring and a large occiput. For an adult, the sniffing position is achieved by elevating the head about 10 cm with a pad or towel placed beneath the occiput (shoulders remaining on the supporting surface), flexing the neck and extending the head at the atlanto-occipital joint, either by tilting the head backward with one hand or by pulling up on the mandible or lower jaw bone. Such a technique for achieving the sniffing position in an infant is, however, ineffective. The large tongue of the infant occupies a large amount of space in the infant's airway thus obstructing the infant's airway passage. Additionally, the infant's glottis is located at the level of the fourth cervical vertebra, whereas in the adult the glottis is located at the fifth cervical vertebra Thus, an infant's airway passage is funnel-like in shape in comparison to an adult's, and is quite narrow due to the underdevelopment of the cricoid ring. Perhaps the most significant hindrance to airway patency for an infant is the relatively large size of the infant occiput. The occiput of an infant is somewhat larger than an adult's and results in the infant's head being flexed forward onto the its chest when the infant is lying in the supine position. Thus, when the infant is in the supine position, and the occiput flexes the infant's head forward onto its chest, the oropharyngeal, laryngeal and tracheal axes are naturally misaligned. To overcome the large occiput factor, a properly dimensioned support must be placed beneath the infant's atlanto-occipital joint, hyperextending the neck to align the oral, laryngeal and tracheal axes. Thus, the infant's head and body are lying in substantially the same horizontal plane to achieve the sniffing position.

Maintaining a stable sniffing position in an infant is also difficult due to the infant's inability to remain in a completely still position for long periods of time. The slightest change in head or body position can cause a major change in the position of an endotracheal tube, for example, which could eventually result in extubation. Thus, some type of device is required to restrain the infant, once its head and body are disposed in the proper position for airway management. Additionally, the infant must sometimes remain in the sniffing position for a long period of time, and a support surface which provides comfort and support to the infant resting thereon is beneficial.

Support cushions or devices for use during surgical procedures are well-known in the prior art.

One example is found in the Watson patent (U.S. Pat. No. 4,259,757) which discloses a support cushion for maintaining a patient's head in the proper position for endotracheal intubation, as well as during other medical procedures. A 7° inclination in the cushion allows the oropharyngeal, laryngeal and tracheal axes of the patient to be aligned when the head is correctly positioned within the depression provided in the cushion. The cushion disclosed in the Watson patent is constructed in accordance with the anatomical features of an adult head. Thus, this cushion would be ineffective in aligning the airway axes of an infant given the infant's relatively large occiput and the other alignment inhibiting anatomical factors discussed above. Furthermore, the Watson patent provides no neck or body support to ensure that the sniffing position is maintained once it is achieved.

Another example is the Clark patent (U.S. Pat. No. 4,757,811) which discloses a self-contained infant restraining device used for emergency treatment on a patient of up to two years old. The device includes a head receiving indentation, a body receiving indentation and a plurality of restraining belts. Although the head indentation allows the head of an infant to be tilted backward below the level of the body into a slightly flexed position for intubation, the position afforded by this device is ineffective for successful intubation of an infant. When an infant is disposed upon the device disclosed in the Clark patent, the infant's head and body lie in two different horizontal planes and the infant's head must be further manipulated to achieve the sniffing position.

The Summer patent (U.S. Pat. No. 4,768,246) discloses an apertured head pillow which does allow the user's head and body to rest generally in the same horizontal surface. However, the device of the Summer patent is not directed to a support for airway management of an infant and does not provide the required neck support to perform the same. Furthermore, the device does not provide a means for restraining the infant's head and body to prevent movement which could dislocate an endotracheal tube, for example, or cause extubation.

Although the Dixon patent (U.S. Pat. No. 4,320,543) discloses a pillow to provide support for the head and neck of the user which incorporates a convoluted upper surface for support, it does not provide a means for aligning the axes of an infant's airway given the special anatomical features of an infant. Thus, the advantages of the present invention are not found in the prior art.

SUMMARY OF THE INVENTION

It is with these problems in mind that the present invention was developed. Unlike the previously used methods of airway management, the present invention does not rely on the skill of the attendant. Rather, by placing an infant on the support, the infant's airway axes are automatically opened and aligned. Furthermore, the support may be used for any type of pre- or post-operative care and provides increased comfort to an infant resting upon the cushion for long periods of time.

In accordance with the purposes of the present invention, as embodied and described herein, the present invention is an apparatus for supporting the head, neck and body of a patient, comprising a head-receiving opening and a head supporting surface, a body-receiving opening and a body supporting surface and a neck support defined between the head-receiving opening and the body-receiving opening which is dimensioned to support the neck of the patient in an extended position. The neck support is formed of a material having a density greater than that of the head-supporting surface. When the head, neck and body of a patient are supported on the apparatus, the axes of the head and neck of the patient are automatically aligned for airway management. The apparatus may be constructed of a foam material, a surface of which may be convoluted to a depth of two centimeters and may further comprise a means for restraining the patient which may include a thorax strap and a leg strap. The head-receiving surface and the body-receiving surface of the apparatus may be disposed in substantially the same horizontal plane. Additionally, the head-receiving opening may be further provided with a plurality of open-ended, concentric shaped cut-outs, the open end of which is located adjacent the neck support. The neck support may have a height of approximately two centimeters.

Furthermore, the invention is embodied in an apparatus for restraining the head, neck and body of a patient for airway management comprising a first cushion having a head-receiving opening for restraining the head of patient, a body-receiving opening for restraining the body of patient, and a neck support for supporting the neck of the patient in an extended position defined between the body-receiving opening and the head-receiving opening. A second cushion is disposed beneath the first cushion to provide a substantially horizontal planar body-supporting surface within the body-receiving opening and a substantially horizontal planar head-supporting surface within the head-receiving opening. The body-supporting surface and the head supporting surface are disposed in substantially the same horizontal plane. The neck support of the apparatus is dimensioned to automatically align the axes of the head and neck of the patient for airway management. The neck support of the apparatus, including the first cushion, second cushion and neck support, may be formed of a material having a density that is greater than that of the material from which the second cushion is formed. The apparatus may be constructed of a foam material, a surface of which may be convoluted. The convolutions of the foam material may have depth of approximately two centimeters. The apparatus may further comprise a means for restraining the patient which may include a thorax strap and a leg strap. The restraining strap may have a width of two to four centimeters and may employ a hook and pile-type fastening means. The apparatus may be further provided with a plurality of open-ended, concentric-shaped cutouts, having a width of approximately two centimeters, which are disposed within the head-receiving opening and body-receiving opening, the open ends of which are located adjacent the neck support.

In the preferred embodiment, the density of the neck support is approximately 1.62 lb/ft$^3$, the density of the second cushion is approximately 1.30 lb/ft$^3$, and the neck support has a height of approximately two inches.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE DRAWINGS

Figure 1:
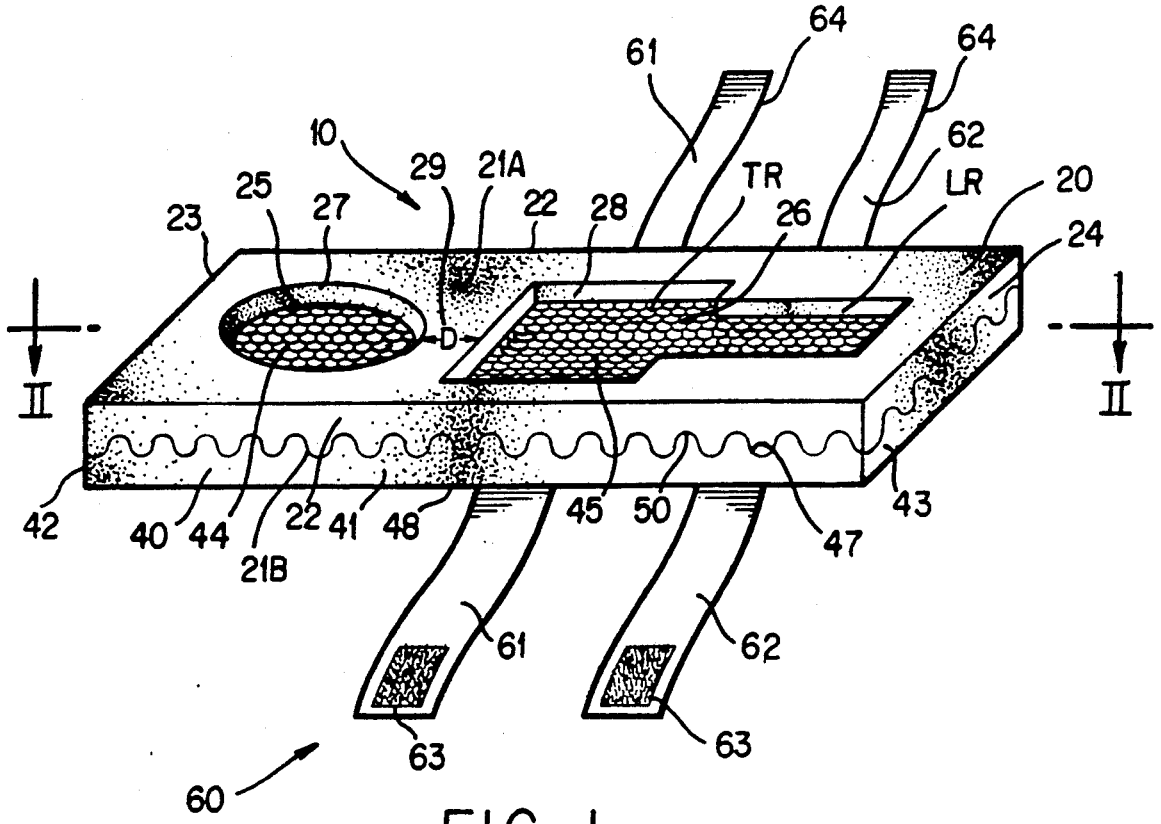
FIG. 1 is a perspective view of the infant support of the present invention.

With continuing reference to the drawing figures in which similar reference numerals are used throughout the description to describe similar features of the invention, the support of the present invention for supporting the head and body of an infant and for automatically aligning the airway axes of an infant is shown generally at 10 in FIG. 1. The support or apparatus 10 comprises a first or top cushion shown generally at 20, a second or base cushion shown generally at 40, and restraining means shown generally at 60. The first cushion 20 and second cushion 40 may be unitary, or they may be individual components joined together by any suitable means to form support 10. As can be seen in FIG. 1, when the second cushion 40 is disposed beneath the first cushion 20, an integral infant support cushion is formed. Each of these individual components will be described in more detail below.

Support 10 is generally rectangular in shape and preferably is dimensioned to be used in combination with a standard Neonatal Intensive Care Unit (NICU) bed, the dimensions of which are approximately $40 \times 80 \times 4$ centimeters.

First cushion 20 comprises a generally planar top surface 21A and bottom surface 21B; a pair of generally planar side surfaces 22 which are substantially perpendicular to top surface 21A; a head end 23; and a leg end 24, also generally planar and substantially perpendicular to top surface 21A. A head-receiving opening 25 is defined in first cushion 20 by a generally circular shaped head supporting wall 27. Wall 27 may be slanted as shown or may be generally perpendicular to top surface 21A and bottom surface 21B. A generally T-shaped body-receiving opening 26 is defined in first cushion 20 by body-supporting wall 28 generally perpendicular to top surface 21A and bottom surface 21B. The depth of first cushion 20 is preferably approximately two inches. Thus, the walls 27 and 28 of both the body-receiving opening 25 and the head-receiving opening 26 are preferably approximately two inches in height.

The head-receiving opening 25 and the body-receiving opening 26 define therebetween a neck support 29. For a typical infant, the distance D of the surface of neck support 29 is preferably approximately 2.5 centimeters; head-receiving opening 25 has a diameter preferably of approximately fourteen centimeters; and body-receiving opening 26 has a length ranging preferably between approximately fifty to sixty centimeters. The torso-receiving region TR of body-receiving opening 26 is of a greater width than leg-receiving region LR of body-receiving opening 26. The support 10 is intended to support all infants ranging from premature to infants of one and one-half years old. The first cushion 20, dimensioned as described above, is intended to support a typical, approximately six month old infant. The following chart, however, lists the preferred dimensions of the head-receiving opening 25, the neck support 29, and the body-receiving opening 26 of first cushion 20 for infants of various maturity.

| Age | Head-Receiving Opening 25 (Diameter) | Neck Support Surface 29 (Width) | Body-Receiving Opening 26 (Length) |
|---|---|---|---|
| Premature–Full Term | 8 cm | 1 cm | 24–36 cm |
| Full Term–6 mos. | 10 cm | 2 cm | 40 cm |
| 6 mos–1 year | 14 cm | 3 cm | 50–60 cm |
| 1 year–1½ years | 16 cm | 4 cm | 60–68 cm |

It should be noted that regardless of the dimensions of the head-receiving opening 25, the neck support 29 or the body-receiving opening 26, the preferred density of first cushion 20 will remain as described below.

The first cushion 20 including neck support 29, is preferably constructed of a closed or open cell foam material having a density of approximately 1.55 to 1.7 $lb/ft^3$, the preferred density being approximately 1.62 $lb/ft^3$. One or more of the outer surfaces of the foam may be convoluted to increase air circulation and thereby, increase comfort. The convolutions preferably have a depth of approximately two centimeters. One example of a suitable convoluted foam is available from E.R. Carpenter Company, Richmond, Va.

Second cushion 40 includes a pair of side surfaces 41, a head end 42, a leg end 43, an upper or top surface 47 and a lower or base surface 48. Side surfaces 41 are generally perpendicular to top surface 47 and base surface 48. The portion of top surface 47 exposed by head-receiving opening 25 and body-receiving opening 26 defines a head-supporting surface 44 and a body-supporting surface 45, respectively. The second cushion 40, also preferably has a two-inch depth, and is constructed of a foam material having at least one convoluted surface. The convolutions preferably have a depth of approximately two centimeters. It is preferred that second cushion 40 have a density less than that of first cushion 20, the density of second cushion 40 preferably ranges from approximately 1.25 to 1.35 $lb/ft^3$, the preferred density is approximately 1.3 $lb/ft^3$.

Figure 4:
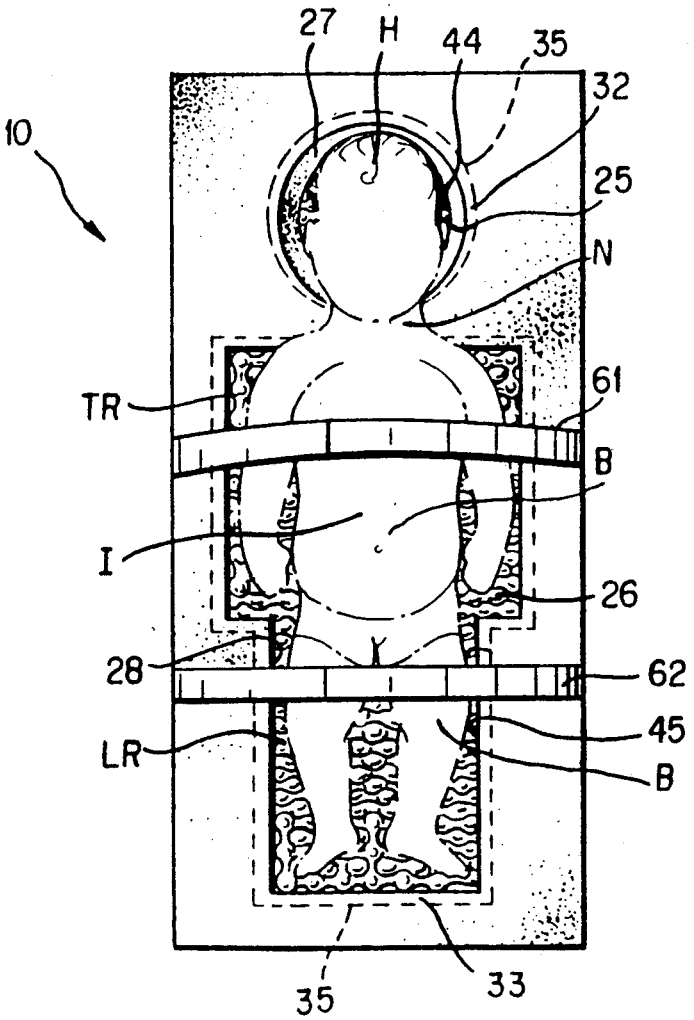
FIG. 4 is a top plan view of the support shown in FIG. 1.

Restraining means 60 are provided to maintain the properly positioned infant. Restraining means 60 is preferably a pair of restraining straps, comprising a thorax strap 61 and a leg strap 62 each having a width of preferably approximately two to four centimeters. Restraining means 60 may take forms other than a pair of straps, e.g., a single strap that extends across the entire width of the support. The restraining means 60 may utilize any conventional fastening mechanism, generally shown as 63 and 64; for example, a hook and pile-type fastening means. As seen in FIG. 4, thorax restraining strap 61 is generally located in the thorax region TR of body-receiving opening 26 while leg strap 62 is generally located in the leg region LR of body-receiving opening 26 of the infant support 10.

Figure 2:
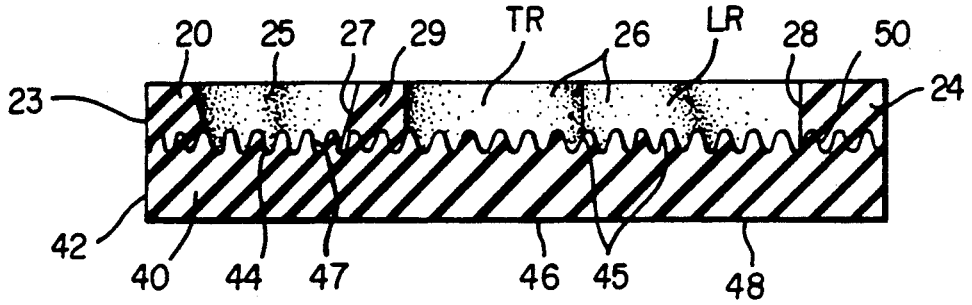
FIG. 2 is a longitudinal cross-sectional view taken along the line II—II of FIG. 1.

Turning now to FIG. 2, a cross-section of the upper portion of the infant support of FIG. 1 is shown. As can best be seen in this Figure, first support cushion 20 and second support cushion 40 are formed of a single surface convoluted foam material, the convoluted surfaces being fitted together and glued or otherwise joined at 50 to form an integral support. As also can be seen in FIG. 2, wall 27 of head-receiving opening 25 is slanted or beveled to cradle and support the relatively large head of an infant placed therein. The body of the infant is received within the body-receiving opening 26 wherein the thorax of the infant's body falls within the thorax region TR of the body-receiving opening, and the legs of the infant rest generally within the leg-receiving region LR of body-receiving opening 26. As best seen in FIG. 2, neck support 29 is of a height equal to that of the remainder of the first supporting cushion 20, approximately two inches. The neck of the infant is generally received by the surface of neck support 29, between head-receiving opening 25 and body-receiving opening 26. Furthermore, the head-receiving surface 44 and the body-receiving surface 45 of second cushion 40 lie substantially within the same horizontal plane. This structure supports the infant's head and body in a manner to aid in successful endotracheal intubation and airway management. As previously discussed, the infant occiput is relatively large in comparison to that of the adult occiput. Thus, when the infant is lying in the supine position, the head and neck of the infant is in a naturally flexed position forcing the infant's chin onto its chest. Therefore, support is needed beneath the neck to hyperextend the neck of the infant for successful endotracheal intubation.

When the infant is placed upon the support cushion 10, the infant's head is received within the head-receiving opening 25 and the infant's body is received within the body-receiving opening 26. In view of the above, the head-supporting surface 44 and the body-receiving surface 45 support the infant in a substantially horizontal planar position, a condition necessary to prevent the natural flexation of the infant head onto its chest. The infant's head falls within the head-receiving opening 25 and is cradled or supported therein by wall 27. The infant's body is supported by wall 28 of the body-receiving opening 26 and is restrained from relative lateral movement. Neck support 29 serves to support and hyperextend the neck of the infant, preventing its head from falling towards its chest, for proper airway management.

Figure 3:
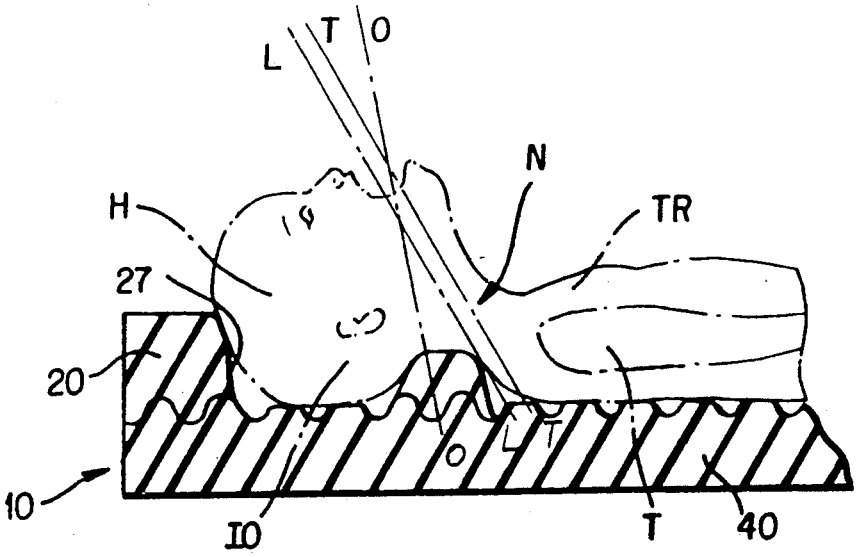
FIG. 3 is a cross-sectional view of the upper body portion of the support in use by an infant, depicting the alignment of the laryngeal, oropharyngeal and tracheal axes for proper airway management.

FIG. 3 depicts the infant support 10 during use in which an infant is resting in a supine position with its head received within the head-receiving opening 25 and its thorax T is received within the thorax region TR of body-receiving opening 26. The infant's occiput IO and the infant's thorax T lie substantially within the same horizontal plane. The infant's neck N is supported by neck support 29. As shown in FIG. 3, when an infant is positioned on the support 10 with its head and body lying within the same horizontal plane, and its neck is supported by the neck-supporting surface 29, the oropharyngeal axis O—O, the laryngeal axis L—L, and the tracheal axis T—T are automatically aligned for proper airway management. As noted above, and as can be seen in FIG. 3, wall 27 of head-receiving opening 25 is beveled to prevent the infant's head from movement which may cause loss of breathing in severe cases, to dislodgement of any intubation equipment being used with the infant. Thus, when the infant's body and head are positioned on the support cushion, the infant's head and body are cradled within cushion 10 and the oropharyngeal O—O, laryngeal L—L, and tracheal T—T axes of the infant's head and neck are aligned, and the sniffing position is obtained for proper airway management. Further, the infant is restrained from movement.

Turning now to FIG. 4, which illustrates an infant I which has been placed upon the infant support 10 and is maintained by restraining straps 61 and 62. It should be noted that the infant's head H is supported and cradled by wall 27 of head-receiving opening 25 and that the body B of infant I is received and supported by the walls 28 of body-receiving opening 26. The body B and head H rest on the convoluted foam surface of head-supporting surface 44 and body-supporting surface 45 respectively. Infant I, once properly positioned on support 10 and restrained by straps 61 and 62, is ready for endotracheal intubation or other pre- or post-operative care. The infant's head and body now lie within substantially the same plane and the neck is supported and extended by the neck support 29.

As can be seen in FIG. 4, the head-receiving opening 25 may be fitted with several concentric open-ended, cut-outs 32 to adjust the width of the head-receiving opening 25 to fit various infant head sizes. One edge 35 of the cut-out 32 is perforated so that it may be separated and removed from head-receiving opening 25 to accommodate a large head. Several similarly shaped concentric cut-outs 33 may also be provided for the body-receiving opening 26. Cut-outs 33 may be removed from the body-receiving opening by perforations 35 to adjust the length and width of the opening to a particular infant body. The open end of both the head and body cut-outs 32 and 33 are adjacent neck support 29.

Should the head-receiving opening need to be enlarged, concentric cut-outs 32 may be removed until the correct size is achieved. The same is true for the body-receiving opening. Should the infant's body exceed the length of the present body-receiving opening 26, cut-outs 33 may be removed from the body-receiving opening 26 until the correct size is obtained. Cut-outs 32 and 33 are preferably approximately two centimeters wide and may be removed in accordance with the chart previously discussed to achieve a support which will accommodate an infant of any age up to one and one-half years old. Therefore, the cut-outs 32 and 33 may be of any width, which upon removal, would still allow adjustment of the diameter of head-receiving opening 25 and the width and length of body-receiving opening 26.

It should be noted that the infant support of the present invention may not only be utilized for proper endotracheal intubation, but may also be used for general comfort of an infant during any type of pre- or post-operative care including, for example, radiological procedures. To provide further comfort for a recovering infant, the support may include a means for moderating the temperature of the infant positioned on the infant support. Such a moderating means could be in the form of water-filled coils which may be heated and cooled, depending upon the particular need of the infant. Also, a lambswool liner may be placed in the body-receiving opening 26 of the infant support 10 to aid in warming an infant and/or for general comfort.

While the support pillow is extremely useful in medical procedures, it is not intended to be limited thereto. For instance, the support cushion may be used in isolettes, bassinets, cribs, or may be used for transporting an infant to or from the home or hospital. A larger version of the present support cushion could be made to fit a full-size operating table for adult use. Such a cushion could be made to place an adult in the proper position for airway management using the principles taught in U.S. Pat. No. 4,918,774, the teachings of which are herein incorporated by reference. Even if the cushion were not made to place an adult patient in the proper position for airway management, it would, however, place an adult in a neutral, supported position for improved comfort during long-term operating procedures or any other type of pre- or post-operative care.

The invention which is intended to be protected herein should not be construed as limited to the particular forms disclosed, as these are to be regarded as illustrative rather than restrictive. Variations and changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. An apparatus for supporting the head, neck, and body of an infant for airway management comprising:

a head-receiving opening formed within said apparatus and a head-supporting surface within said head-receiving opening;

a body-receiving opening formed within said apparatus and a body-supporting surface within said body-receiving opening;

a neck support defined between said head-receiving opening and said body-receiving opening, said neck support dimensioned to support the neck of said infant in an extended position, said neck support formed of a material having a density greater than that of said head-supporting surface;

wherein when said head, neck and body of said infant are supported on said apparatus, the axes of the head and neck of said infant are automatically aligned for airway management.

2. An apparatus as set forth in claim 1, wherein said head-receiving surface and said body-receiving surface are disposed in substantially the same horizontal plane.

3. An apparatus as set forth in claim 1, wherein said material of said neck support has a density within the range of approximately 1.55 to 1.7 lb/ft$^3$.

4. An apparatus as set forth in claim 3, wherein said density is approximately 1.62 lb/ft$^3$.

5. An apparatus as set forth in claim 1, wherein said head supporting surface is comprised of a material having a density within the range of approximately 1.25 to 1.35 lb/ft$^3$.

6. An apparatus as set forth in claim 5, wherein said density is approximately 1.30 lb/ft$^3$.

7. An apparatus as set forth in claim 1, wherein said apparatus is constructed of a foam material.

8. An apparatus as set forth in claim 7, wherein one surface of said foam material is convoluted.

9. An apparatus as set forth in claim 8, wherein the convolutions of said foam material have a depth of approximately 2 centimeters.

10. An apparatus as set forth in claim 1, further comprising means for restraining said infant.

11. An apparatus as set forth in claim 10, wherein said restraining means comprises a thorax strap and a leg strap.

12. An apparatus as set forth in claim 1, further comprising a plurality of open-ended, concentric shaped cut-outs disposed within said head-receiving opening, said open end of said cut-outs located adjacent to said neck support.

13. An apparatus as set forth in claim 1, wherein said neck support has a height of approximately 2 inches.

14. An apparatus for supporting and restraining the head, neck and body of a patient for airway management comprising:

a first cushion having a head-receiving opening for restraining and supporting the head of a patient and a body-receiving opening for restraining and supporting the body of the patient;

a neck support for supporting the neck of the patient in an extended position defined between said body-receiving opening and said head-receiving opening; and a second cushion, disposed below said first cushion, providing a substantially horizontal planar body-supporting surface within said body-receiving opening and providing a substantially horizontal planar head-supporting surface within said head-receiving opening, and body-supporting surface and said head-supporting surface disposed in substantially the same horizontal plane, said second cushion including a base surface, said base surface being substantially parallel to said body-supporting surface and said head-supporting surface;

wherein said neck support is dimensioned to automatically align the axes of the head and neck of a patient for airway management when positioned thereon.

15. An apparatus as set forth in claim 14, wherein said neck support is formed of a material having a density that is greater than that of the material from which said second cushion is formed.

16. An apparatus as set forth in claim 15, wherein said material of said neck support has a density within the range of approximately 1.55 to 1.7 $lb/ft^3$.

17. An apparatus as set forth in claim 16, wherein said density is approximately 1.62 $lb/ft^3$.

18. An apparatus as set forth in claim 15, wherein said material of said second cushion has a density within the range of approximately 1.25 to 1.35 $lb/ft^3$.

19. An apparatus as set forth in claim 18, wherein said density is approximately 1.30 $lb/ft^3$.

20. An apparatus as set forth in claim 14, wherein said first and second cushions and said neck support are constructed of a foam material.

21. An apparatus as set forth in claim 20, wherein a surface of said foam material is convoluted.

22. An apparatus as set forth in claim 21, wherein the convolutions of said foam have a depth of approximately 2 centimeters.

23. An apparatus as set forth in claim 14, wherein said apparatus further comprises means for restraining said patient.

24. An apparatus as set forth in claim 23, wherein said restraining means comprises a thorax strap and a leg strap.

25. An apparatus as set forth in claim 24, wherein said thorax strap and said leg strap each have a width within the range of approximately two to four centimeters.

26. An apparatus as set forth in claim 23, wherein said restraining means includes a hook and pile-type fastener.

27. An apparatus as set forth in claim 14, further comprising a plurality of open-ended, concentric-shaped cut-outs disposed within said head-receiving opening.

28. An apparatus as set forth in claim 27, further comprising a plurality of open-ended, concentric-shaped cut-outs disposed within said body-receiving opening.

29. An apparatus as set forth in claim 28, wherein each of said cut-outs are approximately 2 centimeters in width.

30. An apparatus as set forth in claim 27, wherein the open end of each of said cut-outs is adjacent said neck support.

31. An apparatus as set forth in claim 14, wherein said neck support has a height of approximately 2 inches.

* * * * *

UNITED STATES PATENT AND TRADEMARK OFFICE

CERTIFICATE OF CORRECTION

PATENT NO. : 5,048,136

DATED : September 17, 1991

INVENTOR(S) : Popitz, M. D.

It is certified that error appears in the above-identified patent and that said Letters Patent is hereby corrected as shown below:

Column 9, line 34, delete "and" and insert —said— therefor.

Signed and Sealed this

Fifth Day of January, 1993

*Attest:*

DOUGLAS B. COMER

*Attesting Officer*

*Acting Commissioner of Patents and Trademarks*